US009709050B2

(12) United States Patent
Sarkisian et al.

(10) Patent No.: US 9,709,050 B2
(45) Date of Patent: Jul. 18, 2017

(54) SOLUTION PUMP SYSTEM

(71) Applicant: ROCKY RESEARCH, Boulder City, NV (US)

(72) Inventors: Paul Sarkisian, Boulder City, NV (US); Uwe Rockenfeller, Boulder City, NV (US)

(73) Assignee: Rocky Research, Boulder City, NV (US)

( * ) Notice: Subject to any disclaimer, the term of this patent is extended or adjusted under 35 U.S.C. 154(b) by 400 days.

(21) Appl. No.: 14/149,232

(22) Filed: Jan. 7, 2014

(65) Prior Publication Data

US 2015/0192118 A1 Jul. 9, 2015

(51) Int. Cl.
*F04B 43/067* (2006.01)
*F04B 45/053* (2006.01)

(52) U.S. Cl.
CPC ..... *F04B 43/067* (2013.01); *F04B 45/0533* (2013.01)

(58) Field of Classification Search
CPC ..... F04B 43/02; F04B 43/023; F04B 43/04; F04B 43/043; F04B 43/047; F04B 43/0054; F04B 43/067; F04B 43/0736; F04B 17/042; F04B 17/04; F04B 35/045; F04B 45/041; A61M 2205/12; A61M 2205/581; A61M 1/28; A61M 1/288
USPC ..... 417/269, 395, 559, 560, 566, 569, 571, 417/413.1, 413.2
See application file for complete search history.

(56) References Cited

U.S. PATENT DOCUMENTS

| | | | | |
|---|---|---|---|---|
| 3,586,462 | A | 6/1971 | Kaiser | |
| 5,071,763 | A * | 12/1991 | Somkuti | A23C 9/1206 435/252.3 |
| 5,074,763 | A * | 12/1991 | Degremont | F04B 49/121 417/413.1 |
| 6,705,111 | B1 * | 3/2004 | Rockenfeller | F04B 43/067 62/324.2 |
| 6,899,530 | B2 * | 5/2005 | Lehrke | F04B 43/06 417/385 |
| 7,726,954 | B2 | 6/2010 | Ben-Yosef et al. | |
| 2003/0217962 | A1 * | 11/2003 | Childers | A61M 1/28 210/258 |
| 2011/0054397 | A1 * | 3/2011 | Menot | A61M 5/14224 604/110 |

(Continued)

OTHER PUBLICATIONS

Oxford Dictionary—Edge http://web.archive.org/web/20130917202826/http://oxforddictionaries.com/us/definition/american_english/edge.*

(Continued)

*Primary Examiner* — William H Rodriguez
*Assistant Examiner* — Christopher Brunjes
(74) *Attorney, Agent, or Firm* — Knobbe, Martens, Olson & Bear LLP

(57) ABSTRACT

A plunger driven solution pump is described that is configured to have a diaphragm that substantially conforms to the volume of a pump solution chamber when in a fully outwardly deflected state. The solution chamber may have an inlet port and an outlet port form in a concave solution chamber wall. A step, or ridge, may be formed along an outer periphery of the solution chamber wall and adjacent the inlet and outlet ports to prevent the diaphragm from becoming deformed from pressure against the solution chamber wall. This configuration may allow the pump to efficiently self-prime.

23 Claims, 10 Drawing Sheets

(56) References Cited

U.S. PATENT DOCUMENTS

| | | | | |
|---|---|---|---|---|
| 2013/0042753 | A1 | 2/2013 | Becker | |
| 2015/0139821 | A1 * | 5/2015 | Ambrosina | F04B 43/06 417/53 |

OTHER PUBLICATIONS

International Search Report and Written Opinion, issued in International Application No. PCT/US2015/072692 dated Apr. 28, 2015.

* cited by examiner

SOLUTION PUMP SYSTEM

BACKGROUND

Field of the Invention

Embodiments relate to diaphragm-based solution pumps for moving liquids. More particularly, embodiments relate to solutions pumps for refrigeration systems that are configured to self-prime.

Description of the Related Art

Many different types of systems rely upon solution pumps to move liquids from one part of an apparatus to another. For example, liquid/vapor absorption systems often utilize absorber heat exchange or generator/absorber heat exchange (GAX) cycles for supplying cooling, and heating to an indoor coil and other heat exchange components exposed to the space or load to be conditioned. In these types of apparatus, a solution pump is often used to pump ammonia-rich absorption fluid from the absorber assembly to the generator assembly. This process maintains pressure differentials between the low pressure, absorber side and the high pressure, generator side of the absorption system apparatus. An example of aqua-ammonia an absorption heat pumps using GAX cycles is disclosed in U.S. Pat. No. 6,705,111.

Some solution pumps use a diaphragm for pumping liquid and typically rely on increasing and decreasing the pressure exerted on a diaphragm to change the volume within a pump chamber. In some embodiments of a hydraulic diaphragm pump, a piston is configured to move oil against the diaphragm so that increased pressure from the piston pushes the diaphragm in one direction, while atmospheric pressure or spring pressure on the oil returns the diaphragm to its starting position. This results in a cycling operation of the pump and fluid movement into and out of check valves linked to the pump chamber. Although such pumps function adequately where the system is primed, they do not generate enough suction to be self-priming. Thus, when there is no fluid present in the solution chamber at start up, such presently used hydraulic diaphragm pumps may not perform adequately.

SUMMARY

Embodiments relate to a diaphragm pump that has a solution chamber with a contoured and stepped solution chamber wall. The solution chamber wall has inlet and outlet ports, and the step traverses or is near to the inlet and outlet ports and may be configured to prevent the diaphragm from becoming deformed if it comes in close proximity to the ports. In this embodiment, a hydraulic fluid chamber is configured to contain a varying volume of a hydraulic fluid, the hydraulic fluid chamber comprising a contoured fluid chamber wall. In addition, the diaphragm pump has a flexible diaphragm coupled around a perimeter at an interface between the solution chamber and hydraulic fluid chamber, wherein the varying volume of hydraulic fluid deflects the flexible diaphragm between an outwardly deflected position and an inwardly deflected position, and wherein the flexible diaphragm, in the outwardly deflected position, substantially conforms to the contoured solution chamber wall, wherein the step allows sufficient clearance at the inlet and outlet ports.

In one embodiment, a diaphragm pump includes a solution chamber having a contoured solution chamber wall, an inlet port and an outlet port located at least partially in the solution chamber wall and configured to allow solution to move into and out of the solution chamber. The chamber wall may also have a step traversing or near to the inlet port and the outlet port. The diaphragm pump may also have a hydraulic fluid chamber configured to contain a varying volume of a hydraulic fluid, wherein the hydraulic fluid chamber has a contoured fluid chamber wall. A flexible diaphragm is coupled around a perimeter at an interface between the solution chamber and hydraulic fluid chamber wherein a varying volume of hydraulic fluid deflects the flexible diaphragm between an outwardly deflected position and an inwardly deflected position, and wherein the flexible diaphragm, in the outwardly deflected position, substantially conforms to the contoured solution chamber wall. In some embodiments the step prevents the diaphragm from becoming deformed due to suction into the inlet port and the outlet port.

In further embodiments, the diaphragm pump is a plunger-driven direct drive pump. The diaphragm pump can be capable of suctioning liquid and vapor out of an absorber. The step can be sized such that the step does not substantially increase the volume of the solution chamber with respect to a shape of the flexible diaphragm in the outwardly deflected position. The contoured solution chamber wall can conform to a predetermined radius. The flexible diaphragm can have a predetermined radius that is substantially the same as the predetermined radius of the interior wall of the solution chamber. The inlet port and the outlet port can comprise one-way valves. The inlet port can be in fluid communication with an inlet pipe configured to draw fluid into the solution chamber. The inlet pipe can be in fluid communication with an absorber. In various embodiments, the diaphragm pump can be capable of self-priming a solution through greater than six inches of liquid column height, greater than twelve inches of liquid column height, or greater than 24 inches of liquid column height.

The diaphragm pump can include an output shaft configured to cause lateral movement of an eccentric D-ring that reciprocally drives a plunger with respect to the diaphragm. The eccentric D-ring can comprise at least one flat portion that contacts the plunger to reciprocally drive the plunger with respect to the diaphragm. The eccentric D-ring can maintain an orientation with respect to a plane formed by the at least one flat portion during lateral movement.

In an embodiment, a method for self-priming a diaphragm pump includes providing a diaphragm pump comprising a solution chamber comprising a contoured solution chamber wall, an inlet port and an outlet port located at least partially in the solution chamber wall configured to allow solution to move into and out of the solution chamber, and a step traversing or near to the inlet port and the outlet port; a hydraulic fluid chamber configured to contain a varying volume of a hydraulic fluid, the hydraulic fluid chamber comprising a contoured fluid chamber wall; and a flexible diaphragm coupled around a perimeter at an interface between the solution chamber and hydraulic fluid chamber, wherein the varying volume of hydraulic fluid deflects the flexible diaphragm between an outwardly deflected position and an inwardly deflected position and wherein the flexible diaphragm, in the outwardly deflected position, substantially conforms to the contoured solution chamber wall; and wherein the step prevents the diaphragm from becoming embossed due to suction into the inlet port and the outlet port. In one embodiment, the diaphragm pump is in fluid communication with a solution and activating the pump when there is no solution in the solution chamber so that the pump draws the solution into the solution chamber.

In further embodiments, the diaphragm pump can be connected to the solution through a fluid inlet pipe, and the solution in the fluid inlet pipe can be an aqueous ammonia solution. In various embodiments, the diaphragm pump can be capable of self-priming a solution through greater than six inches of liquid column height, through greater than twelve inches of liquid column height, or through greater than twenty four inches of liquid column height. The contoured solution chamber wall can conform to a predetermined radius. The flexible diaphragm can have a predetermined radius that is substantially the same as the predetermined radius of the contoured solution chamber wall.

DETAILED DESCRIPTION OF THE PREFERRED EMBODIMENTS

Figure 1A:
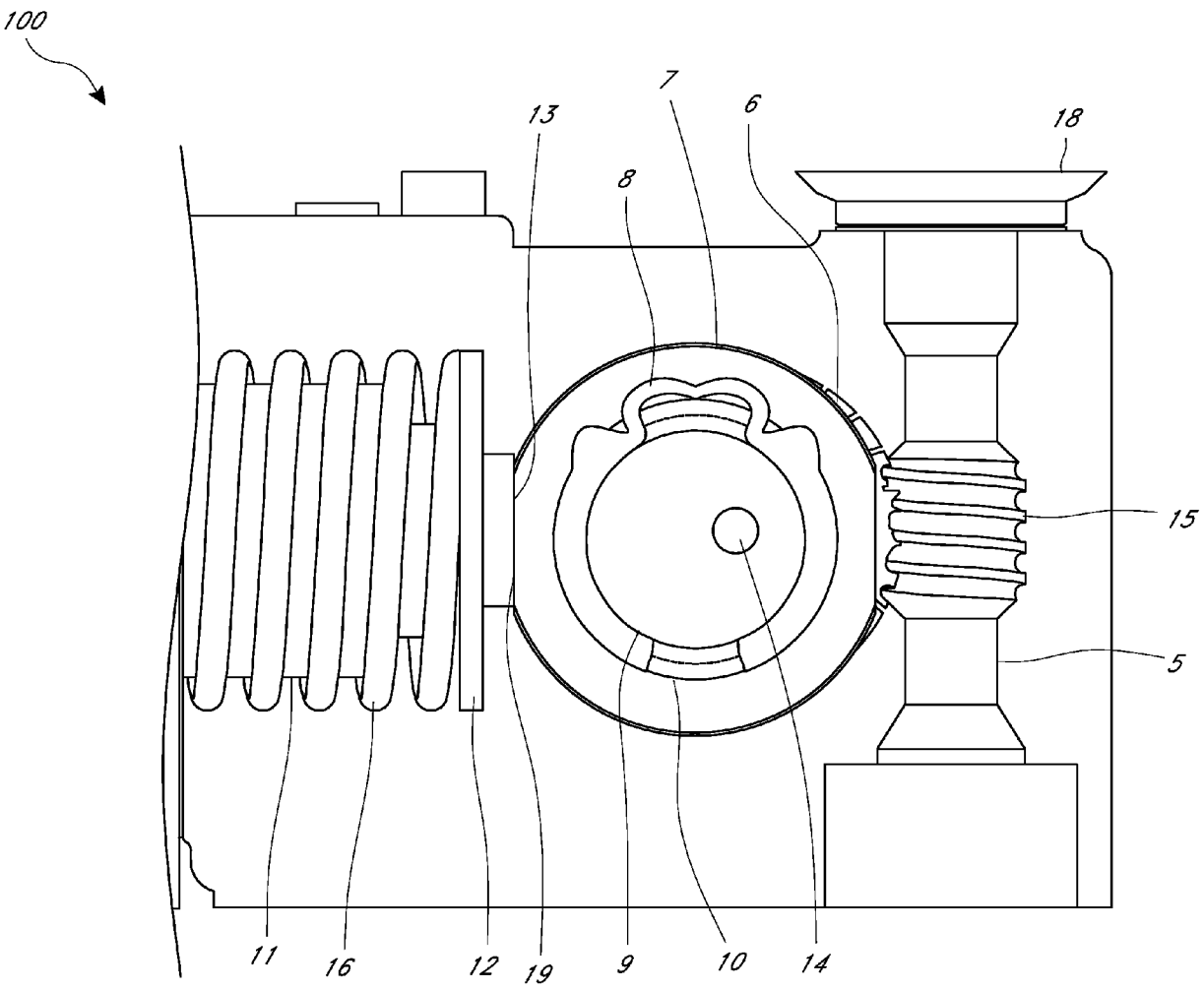
FIG. 1A illustrates a cut-away perspective view of a portion of an example plunger-driven diaphragm solution pump.

Embodiments relate to solution pumps that are capable of self-priming through an inlet pipe. In some embodiments, the solution pump is a plunger-driven hydraulic diaphragm solution pump having a solution chamber. In this embodiment, the diaphragm substantially conforms to a concave interior surface of the solution chamber. By substantially conforming to the interior surface of the solution chamber, the solution pump is capable of pumping vapor for an extended period of time until solution is drawn into the solution chamber. In addition, the concave interior surface of the solution pump may include a step or ridge that is formed along a periphery surface, and circumscribe the outer circumference of the surface adjacent the inlet port and outlet ports. This step may help prevent the diaphragm from becoming deformed by inlet and outlet ports formed in the solution chamber wall.

In this manner, the step helps keep the diaphragm from entering into the inlet or outlet ports and becoming deformed or embossed during operation. In addition, because the diaphragm may be configured to substantially conform to the interior surface of the solution chamber wall, this can allow the solution pump to self-prime though an inlet tube which would allow the pump to move gas or vapor with enough suction to draw a liquid solution from 3, 6, 12, 18, 24, 36 or more inches up from a liquid-vapor interface free surface. Alternatively, the solution pump could provide this equivalent amount of suction to a vessel containing a gas, liquid or two phase fluid mixture.

In some cases, this solution pump can be used in an absorption fluid loop for pumping absorption fluid. In one embodiment, the absorption fluid has an ammonia concentration of between about 20% and about 60% by weight, from the absorber assembly to the generator assembly.

In an embodiment, the pump includes an electric motor and an input shaft driven by the electric motor to rotate about the input shaft axis. The input shaft can include a worm gear. The pump can also include an output shaft having a gear at a first end which engages the worm gear on the input shaft to rotate the output shaft about the output shaft axis. The output shaft can have, in some embodiments, an eccentric cam at a second end. The eccentric cam can be coupled to the output shaft with its center offset from the output shaft axis. The eccentric cam can be coupled to an eccentric D-ring such that the eccentric D-ring achieves lateral movement while an orientation of the eccentric D-ring does not change as the output shaft rotates. The eccentric D-ring can have an engagement surface configured to engage a follower portion of a first end of a pump driving member.

A second end of the pump driving member may be proximate to a pumping chamber. The pump driving member can be spring-loaded to resist compression along a pump driving axis in a direction facing the pump chamber. Reciprocal driving along the pump driving axis can be achieved by translating the rotational motion of the output shaft into linear motion as the eccentric D-ring engagement surface engages the follower portion of the spring-loaded pump driving member. Such a solution pump can be capable of operating at relatively high suction temperatures and pressures for cooling operation of a chiller, as well as at low pressures where the heat pump system operates to provide heating, usually at high discharge pressures. Such a solution pump is further able to operate with pumping pressures up to about 500 psi. In addition, in some embodiments the pump is capable of self-priming through liquid column heights of 6, 12, 18, 24 or more inches of water column equivalent. Though the pump is capable of self-priming through such liquid column heights, an inlet port may have a vertical distance rise requirement that is shorter than the liquid column height self-priming capabilities of the pump. The pump can operate on fluids such as water, an ammonia water solution, or another fluid.

I. Overview of Example Pump

FIG. 1A illustrates a cut-away perspective view of a first portion of an example plunger-driven diaphragm solution pump 100. The first portion of the pump 100 includes an input shaft 5, an output shaft 14, and a spring-loaded plunger or piston 12. In some embodiments, the output shaft 14 may have a ball bearing locating in a recessed end of the output shaft. Though discussed herein in the context of an aqua-ammonia absorption system, the plunger-driven diaphragm pump 100 can be implemented in a wide variety of other contexts.

The input shaft 5 is driven by a motor (not shown), secured to motor mount 18, which rotates input shaft 5 about its axis, causing rotation of gear 15. Suitable worm drive gearing between gear 15 on the input shaft 5 and gear 6 mounted on the output causes rotation of the gear 6 and an eccentric cam 9 mounted on the output shaft. The eccentric cam 9 is rotatably coupled to an eccentric D-ring 7, for example by a needle bearing 10 assembly in one embodiment, the eccentric D-ring 7 having at least one flat side 19 for providing contact with a surface end 13 of plunger 12. The rotation of the eccentric cam 9 causes lateral motion of eccentric D-ring 7 relative to the plunger 21. As eccentric D-ring 7 moves laterally from side to side, plunger 12 is operated reciprocally within sleeve 11. The plunger 12 can be biased by spring 16 so that the surface of end 13 of the plunger is urged against the eccentric D-ring 7 of the output shaft assembly.

As shown in FIG. 1A, the eccentric D-ring 7 can have at least one flat or substantially flat portion 19 for engaging a follower portion of a pump driving member, such as the surface end 13 of plunger 12. As the eccentric cam 9 rotates due to the output shaft 14 rotation, the eccentric D-ring 7 can be rotatably coupled to the eccentric cam 9 so as to maintain a parallel orientation of the flat portion 19 to the surface end 13 of the plunger 12 during lateral movement relative to the surface end 13 of the plunger 12. The flat portion 19 against the surface end 13 can serve to maintain a steady orientation of the eccentric D-ring 7. The flat portion 19 can move inward and outward relative to the surface end 13 due to the circular motion of the eccentric cam 9 around the output shaft axis 14. The eccentric D-ring 7 can be secured with a retaining ring 8.

The flat portion 19 of the eccentric D-ring 7 beneficially allows more consistent timing for pushing the plunger 12 as opposed to a rounded or arced contact portion, even as the eccentric D-ring 7 experiences minor wear due to friction with the surface end 13 of plunger 12. Previous pumps employed wheels or other rounded members to contact the follower portion of the pump driving member. Such rounded contact members wear out irregularly and cause inconsistent timing for pushing the plunger. Some embodiments of the eccentric D-ring 7 can have two or more flat contact portions. In some embodiments, when a first used flat contact portion experiences wear, the eccentric D-ring 7 can be "flipped over" or rotated 180 degrees such that another flat contact portion of the D-ring faces the surface end 13 of the plunger 12. Further, if binding causes an inadvertent movement or rotation of the eccentric D-ring, one of the flat portions will quickly reengage the surface 13 of plunger 12. The flat portion 19 can be, in some embodiments, about 10% to about 250% of the radius of the plunger.

Figure 1B:
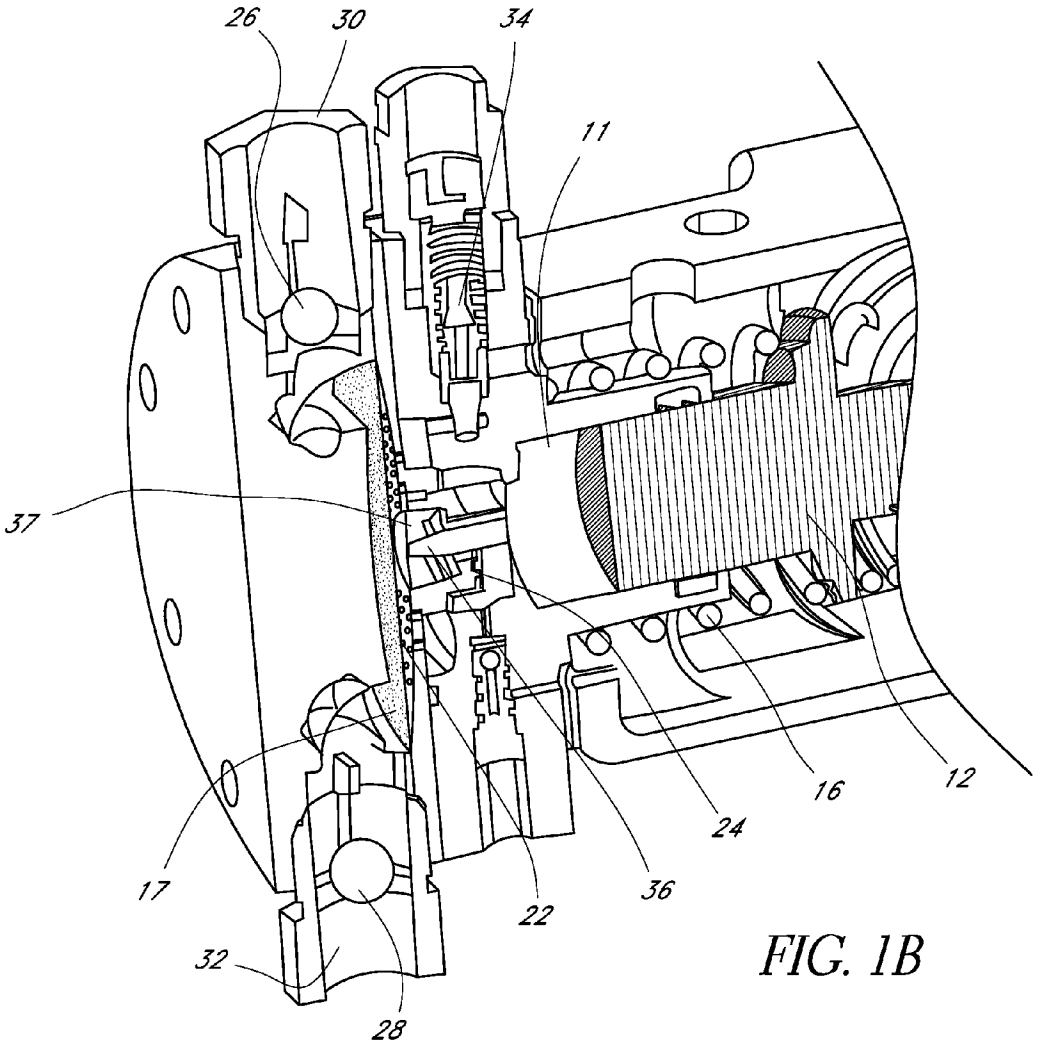
FIG. 1B illustrates a cut-away side view of another portion of the example plunger-driven diaphragm solution pump of FIG. 1A.

The second portion of the solution pump 100 embodiment illustrated in FIG. 1B includes another end of the plunger 12 which operates diaphragm 20 within solution chamber 17 and hydraulic fluid chamber 22. The solution chamber 17 can be formed from a solution chamber wall having a first contour and a step and the hydraulic fluid chamber can be formed from a fluid chamber wall having a second contour. The diaphragm 20 can be secured around a perimeter, the perimeter located around a common edge of the solution chamber 17 and hydraulic fluid chamber 22. The hydraulic fluid chamber 22 contains a varying volume of hydraulic fluid on the side of the diaphragm opposite the solution chamber 17, wherein the volume of the hydraulic fluid in the chamber 22 varies based on the reciprocal motion of the plunger 12.

The reciprocal motion of the plunger 12 displaces the hydraulic fluid into and out of the hydraulic fluid chamber 22. In the illustrated embodiment, the contoured hydraulic fluid chamber wall includes a plurality of small openings for movement of the hydraulic fluid into and out of the hydraulic fluid chamber 22. In another embodiment, fewer and larger openings can be used. In such embodiments, a step similar to that discussed with respect to the solution chamber wall can be used to prevent diaphragm deformation. The hydraulic fluid assists in deflecting the diaphragm 20 between an outwardly deflected condition when the plunger 12 is fully extended to an inwardly deflected state when plunger 12 is fully retracted. The hydraulic fluid provides for a substantially even distribution of pressure over an area of the diaphragm 20 surface due to motion of the plunger 12.

Deflection of the diaphragm 20 out of and into the solution chamber 17 changes the volume of the space formed by the solution chamber wall and the diaphragm. The increase and decrease of the volume of this solution chamber space draws fluid through inlet connection 32 and forces fluid out of outlet connection 30. When the plunger 12 extends and the diaphragm 20 is deflected into the solution chamber 17, absorption fluid in the solution chamber 17 is forced past check valve 26 through outlet connection 30 and into an absorption fluid conduit. When the plunger 12 is retracted, the diaphragm 20 retracts drawing absorption fluid from the absorber into the chamber 17 via inlet connection 32 and check valve 28. In some embodiments, check valve 26 and check valve 28 can be ball check valves, as illustrated. Diaphragm check valves, swing check valves, stop check valves, lift-check valves, in-line check valves, duckbill valves, other suitable one-way valves, or a combination thereof can be implemented in other embodiments.

Replenishment valve 36 is operated by contact with the retracting diaphragm 20 at pressure pad 37. This ensures that replenishment hydraulic fluid is not allowed into the hydraulic fluid chamber 22 unless the diaphragm 20 is in a position to contact pressure pad 37, for example when substantially deflected into the hydraulic fluid chamber 22. Replenishing check valve 24 cooperates with air bleed/relief valve assembly 34 to maintain a full charge of hydraulic fluid in the hydraulic fluid chamber 22. Hydraulic fluid replenishment may occur as hydraulic fluid and any air present is discharged to the crankcase through the air bleed/relief valve assembly 34 during each cycle of the plunger reciprocation.

The size and shape of the solution chamber 17 and diaphragm 20, as well as the material chosen for diaphragm 20, are designed so that the diaphragm 20 substantially conforms to the inner surface of the solution chamber 17 when the diaphragm 20 is outwardly deflected. For example, the deflected diaphragm 20 may have a predetermined radius at maximum deflection. This may be substantially the same radius as the interior surface of the solution chamber such that the diaphragm 20 substantially contacts, the interior surface of the solution chamber during the pumping stroke. In addition, as explained in more detail below with respect to FIG. 5C, some embodiments of the solution chamber 17 can include a step traversing or near to the inlet and outlet ports to prevent permanent deformation of the diaphragm 20.

In this embodiment, the inner surface of the solution chamber 17 is contoured to substantially conform to the deflected volume of the diaphragm 20. Accordingly, the diaphragm 20 when fully outwardly deflected, or substantially fully outwardly deflected, can push all or substantially all of any remaining gas or liquid out of the solution chamber 17. The return motion of the plunger then causes the diaphragm 20 to move away from the solution chamber wall, thereby creating suction of sufficient strength to pull solution, water, or another fluid into the solution chamber 17 should the pump be run in a dry, or substantially dry, state. This self-priming feature advantageously allows the pump to start pumping when the solution chamber 17 is filled with air or vapor and to lift solution, water, solvent, or another suitable fluid into the solution chamber 17. Embodiments are enabled to pump air with sufficient force to lift liquid more than two feet, and more than four feet in some embodiments, through in inlet pipe into the solution pump. Accordingly, the pump can have suction capabilities at ambient temperature of approximately 6 in. $H_20$, 12 in. $H_20$, 24 in. $H_20$, 48 in. $H_20$, or more in some embodiments. Suction capabilities can be slightly greater for aqua-ammonia solutions, which are slightly less dense than $H_20$. In addition, the pump 100 may be suitable for operation at pressures from fractional atmospheric pressures, such as approximately 10 psia or less, to up to 500 psia or more in some embodiments.

Some embodiments of the pump 100 can further include damper means to dampen the noise generated by operation of the pump 100. For example, a volume of solution can be selected that reduces noise. In some embodiments, large inlet tubes can be used to hold the liquid so that it ensured that liquid is pumped at each stroke, providing for quieter pumping than using smaller tubes and pumping less liquid per stroke with the rest being vapor.

II. Overview of Example Diaphragm Deflection

Figure 2C:
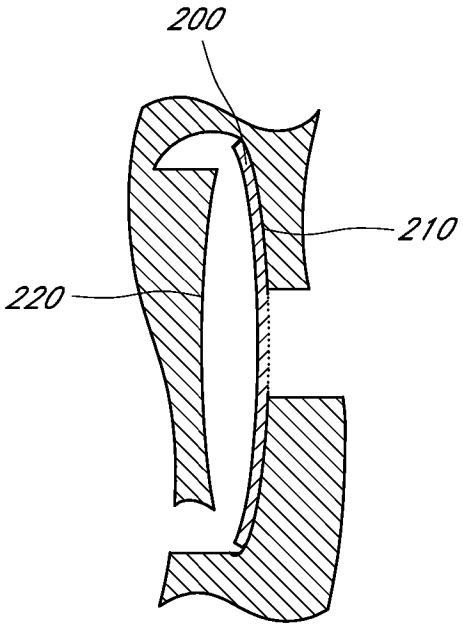
FIGS. 2A-2C illustrate examples of diaphragm deformation within an embodiment of a solution chamber of a solution pump.
Figure 2B:
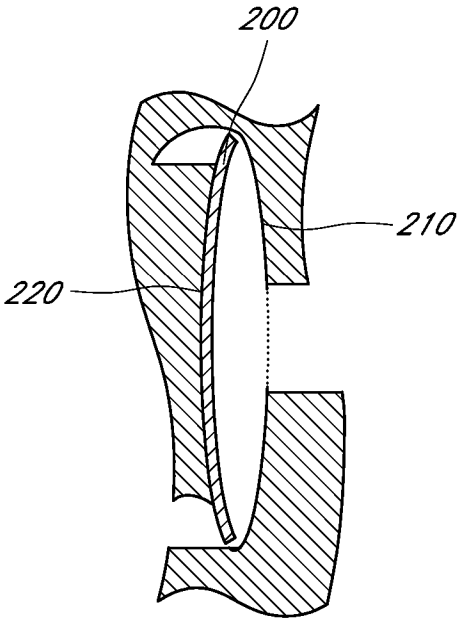
Figure 2A:
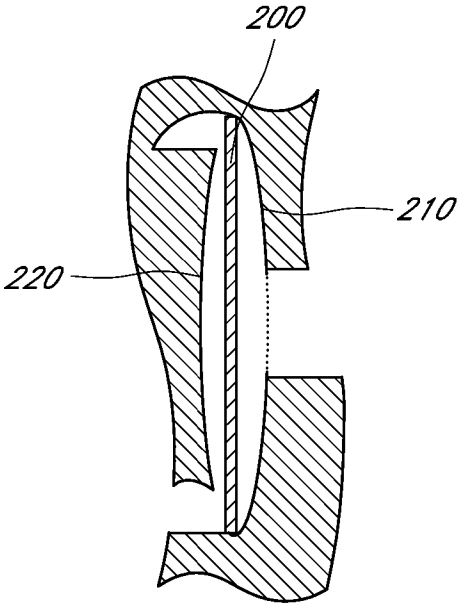

FIGS. 2A-2C illustrate various positions of a diaphragm 200 relative to a solution chamber wall 220 and a hydraulic fluid chamber wall 210. In a neutral position, as illustrated in FIG. 2A, the diaphragm 200 can be substantially flat or undeflected. In a fully outwardly deflected position, the diaphragm 200 substantially conforms to the solution chamber wall 220, as illustrated in FIG. 2B. As illustrated in FIG. 2C, in a fully retracted position, the diaphragm 200 substantially conforms, in some embodiments, to the hydraulic fluid chamber wall 210. The diaphragm 200, in use, can occupy a range of positions between the fully deflected and fully retracted positions, including but not limited to the neutral position.

As discussed above, by enabling the fully outwardly deflected shape of the diaphragm 200 to substantially conform to the shape of the solution chamber wall 220, a pump implementing such a diaphragm and chamber can provide increased pressures, leading to self-priming capabilities as well as the ability to pump vapor as well as liquid. For example, in some embodiments, in order to allow the pump to self-prime, the ratio of pressures and the ratio of volumes can be defined as follows:

$$\frac{V_{min}}{V_{max}} < \frac{P_L}{P_H}$$

where $P_H$ represents the high operating pressure of the system, $P_L$ represents the low operating pressure of the system, $V_{max}$ represents the maximum volume of the solution chamber with the diaphragm deflected out of the chamber, and $V_{min}$ represents the minimum volume of the solution chamber with the diaphragm deflected into the chamber.

A self-priming pump as described herein, may be implemented in an aqua-ammonia or other heating and cooling system and implementing the solution chamber to deflected diaphragm volume ratios approximately described above, can reduce the pressure inside an absorber because the pump can draw gas or liquid. In an aqua-ammonia system, an aqua-ammonia solution absorbs ammonia vapor to into liquid, and accordingly some vapor can be present in the solution chamber of the pump. Thus embodiments of pumps described herein may have improved continuity due to the ability to efficiently pump both vapor and liquid, specifically the ability to suction both vapor and liquid out of an absorber in an aqua-ammonia system. Advantageously, such a direct drive pump as described herein has advantages over other solution pumps such as belt drive pump designs, for example the compact design and relatively lower maintenance of a direct drive pump.

III. Overview of Example Output Shaft Assembly

Figure 3A:
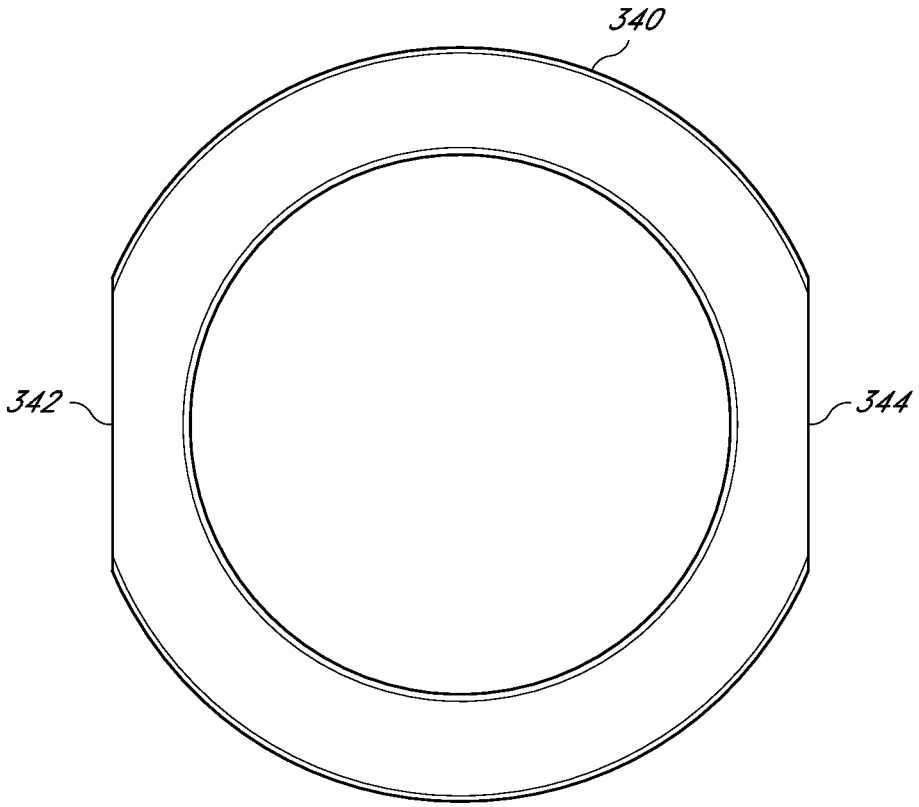
FIG. 3A illustrates an embodiment of an eccentric D-ring that can be employed in the pump of FIG. 1A.

FIG. 3A illustrates an embodiment of an eccentric D-ring 340 that can be employed in the pump of FIG. 1A, or in any other suitable system. The eccentric D-ring 340 can be composed of a material having good strength and wear resistance, for example a metal alloy such as carbon-steel in some embodiments. Eccentric D-ring 340 can include one or more flat portions for engaging another system component such as a follower portion of a plunger or piston. As illustrated, eccentric D-ring 340 has a first flat portion 342 and a second flat portion 344, however eccentric D-ring could have one, two, three, four, or more flat portions in other embodiments. In some implementations, the flat portion or portions can be provided with a material or mechanism to reduce wear and/or reduce friction between the flat portion and a contacting surface, for example polytetrafluoroethylene, molybdenum disulfide, a compacted oxide layer glaze, a liquid or solid lubricant, roller bearings, or the like. In some implementations, the contacting surface, for example the surface end 13 of the plunger 12 described above in FIG. 1A, can be treated similarly to reduce friction.

Figure 3B:
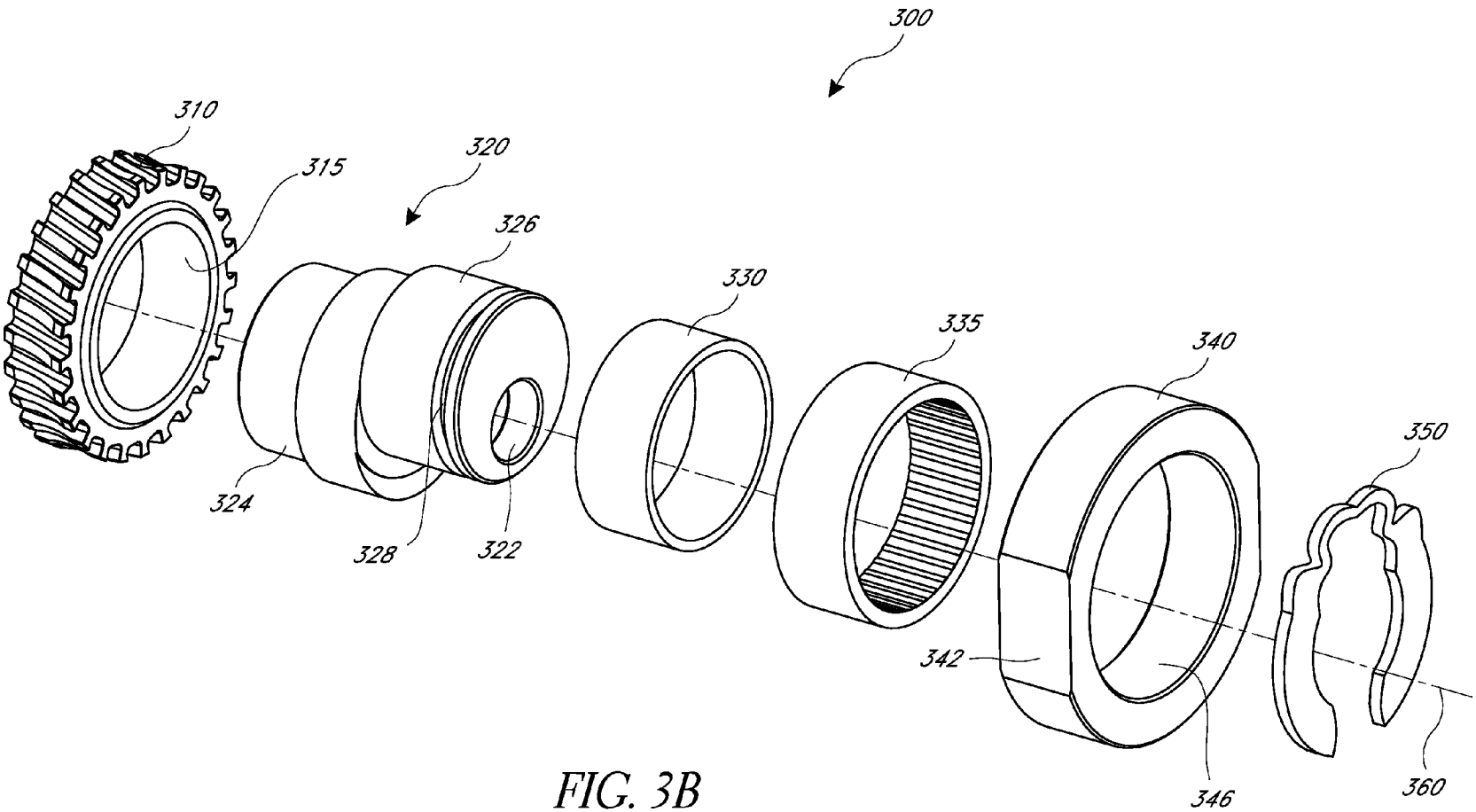
FIG. 3B illustrates an exploded view of an embodiment of an output shaft assembly that can be employed in the pump of FIG. 1A.

FIG. 3B illustrates an exploded view of an embodiment of a drive and eccentric assembly 300 that can be employed in the pump of FIG. 1A. The drive and eccentric assembly 300 includes a gear 310, an eccentric 320, inner 330 and outer 335 roller bearing components, an eccentric D-ring 340, and a retaining ring 350. The illustrated drive and eccentric assembly 300 illustrates one possible mechanism for rotatably coupling the eccentric D-ring 340 to a drive shaft member such that the eccentric D-ring 340, when the drive and eccentric assembly 300 is in use, is capable of providing cyclic linear motion to a plunger or piston while maintaining its orientation relative to a plane formed by flat portion 342.

In some embodiments, gear 310 can be a helical gear. Gear 310 has an inner diameter 315 and is coaxial with an output shaft axis 360. Eccentric cam 320 can be an eccentric circular cam including two or more portions, wherein at least one of the portions has an eccentric rotation around the output shaft axis 360 and another of the portions fits within the inner diameter 315 of the helical gear. For example, a first or coaxial cam portion 324 of the eccentric cam 320 can be sized with a suitable diameter and depth to be positioned within the inner diameter 315 of the gear 310. The first cam portion 324, gear 310, and an output shaft member (not illustrated) can be coaxial. Accordingly, when the gear 310 drives rotation of the output assembly 300, the first portion 324 of the eccentric cam 320 can rotate about the output shaft axis 360. An eccentric portion 326 of the eccentric cam 320 can be secured to the first portion 324 in some embodiments or, as in the illustrated embodiment, to an intermediate portion having a larger diameter than the first portion 324 and also rotating around the output shaft axis 360. The eccentric portion 326 can be positioned such that a through hole 322 running through the thickness of eccentric cam 320 is offset from the center of the eccentric portion 326. A center of the through hole 322 can be aligned with the output shaft axis 360. In other embodiments, other eccentric cam arrangements can be used to drive the lateral motion of the eccentric D-ring 340 relative to a pump driving member, such as a plunger.

An inner race 330 of a needle bearing assembly can be sized with an inner diameter that fits around an outer diameter of the eccentric portion 326. An outer race 335 of the needle bearing assembly can be sized to fit over the inner needle bearing race 330 and within an inner diameter 346 of the eccentric D-ring 340. The needle bearing assembly 330, 335 can reduce the friction of the eccentric D-ring 340 as its inner surface 346 rotates relative to the outer surface of the eccentric portion 326 of eccentric cam 320. Other rotatable coupling means may be used between the eccentric portion 326 and the eccentric D-ring 340 in other embodiments. The eccentric D-ring 340 and needle bearing assembly 330, 335 can be secured to the eccentric portion 326 of the eccentric cam 320 using a retaining ring 350 placed in groove 328, in some embodiments.

IV. Overview of Example Systems

Figure 4A:
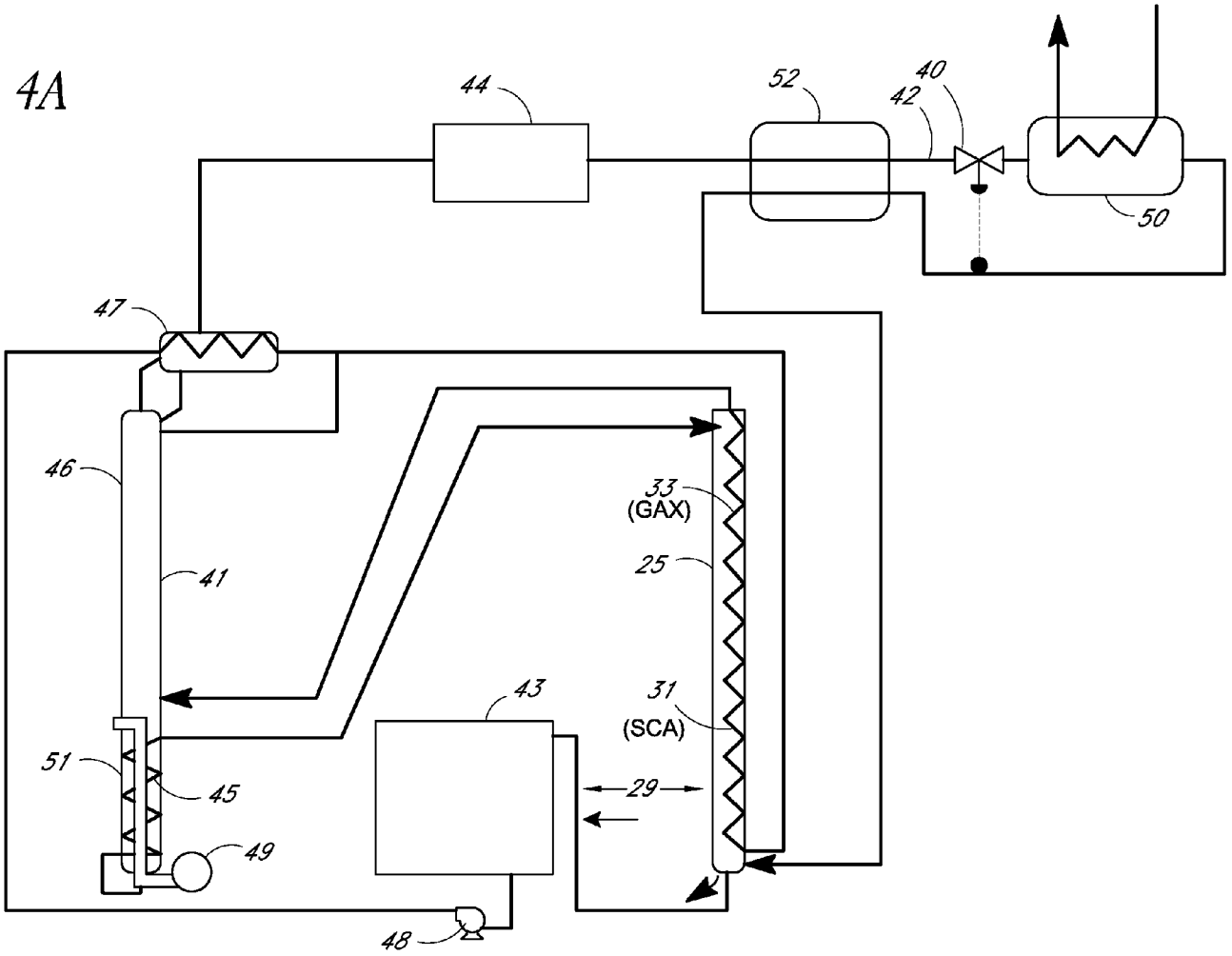
FIG. 4A illustrates a high-level schematic diagram of an example aqua-ammonia absorption system that can implement a solution pump of the type illustrated in FIGS. 1A-1C.
Figure 4B:
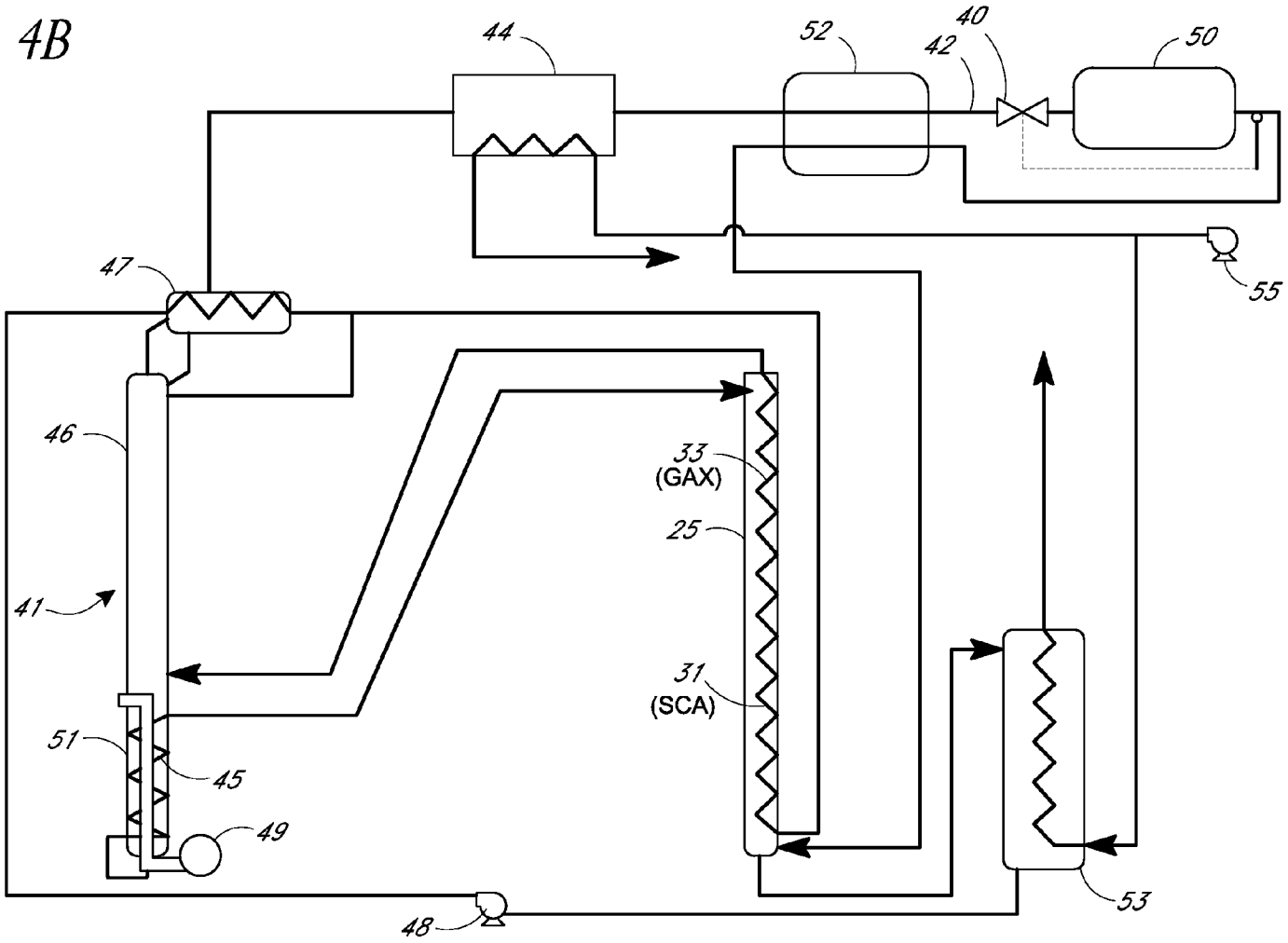
FIG. 4B illustrates a high-level schematic diagram of another example aqua-ammonia absorption system that can implement a solution pump of the type illustrated in FIGS. 1A-1C.

FIGS. 4A and 4B schematically illustrate aqua-ammonia cooling and heating systems in which the solution pump described herein may be effectively utilized. FIG. 4A shows an air conditioner/chiller cooling apparatus and FIG. 4B illustrates a heat pump for operating in a heating mode. The major components of the chiller system embodiment illustrated include an absorber assembly 29 comprising an air-cooled absorber 43 and an absorber heat exchange section 25 which includes an absorber heat exchanger 31, sometimes referred to as a solution cooled absorber (SCA), and a GAX heat exchanger 33. The generator assembly 41 shown includes a generator heat exchanger 45, a boiler 51 having a burner 49 for heating and vaporizing the solution, an adiabatic section 46, and a rectifier section 47. The burner may include a combustion air pre-heater. A condenser 44 and an evaporator 50 are the other major components of the system. The chiller system shown includes a subcooler 52 for precooling refrigerant from the condenser with cold gaseous refrigerant from the evaporator. A TXV valve 40 located along the refrigerant pipe 42 controls the flow of refrigerant to the evaporator. The absorber and condenser heat exchangers may be air or liquid cooled, and the rectifier 47 may be cooled by solution, water or air. Such a GAX chiller is well-known in the art, for example, U.S. Pat. Nos. 5,490,393 and 5,367,884.

The heat pump embodiment shown in FIG. 4B incorporates many of the same major components described in the FIG. 4A apparatus, but in which a hydronically cooled absorber 53 is shown, with a hydronic pump 55 and appropriate piping for directing a heat transfer fluid to the absorber and to the condenser for transferring heat. In both embodiments shown, a plunger-driven diaphragm solution pump 48 is used for pumping ammonia-rich absorption fluid from the absorber to the rectifier. Solution migration, or migration of solution from high to low pressure regions, can cause solution build-up in the absorber, thereby causing reductions in capacity and coefficient of performance (COP). Advantageously, in some embodiments the solution pump 48 can suction the solution out of the absorber and recirculate the liquid through the system, improving performance. The net positive suction head of the solution pump 48 is sufficient to draw a slight vacuum in the absorber and keep solution circulating through the system.

Such a heat pump may be modified to provide heating and cooling by incorporating an appropriate reversing valve, as described in the aforesaid patents. The solution pump described herein may be used, as well, in an aqua-ammonia chiller-heater as further described in U.S. Pat. No. 6,718,792 issued on Apr. 13, 2004. Moreover, the solution pump as described herein may also be used in non-GAX aqua-ammonia systems such as described in the aforesaid patents and applications.

The plunger-driven diaphragm solution pump described herein may be used in an aqua-ammonia absorption system for pumping an absorption fluid having an ammonia concentration of between about 20% and about 60%, by weight, particularly a GAX absorption system, and more particularly a heat pump system which operates at both high temperature, high pressure and low temperature, low pressure modes of operation. Such a pump offers significant advantages in that at relatively low temperature operation, where suction pressures are often less than ambient, e.g., less than about 14 psia, and even as low as about 5-10 psia during cold temperature operation, the pump functions efficiently, unlike presently used hydraulically operated diaphragm solution pumps. The pump described herein is capable of pumping ammonia-rich solution flows of between about 2 and about 8 pounds per minute for a 2½-8-ton rated apparatus.

Low-side system pressures in which the pump efficiently operates are between about 5-10 psia and about 80 psia, for example when outside temperatures are particularly cold, for example, at or below about −20° F. Thus, the pump is capable of pumping at required flow rates at low temperature, low pressure conditions, and whereby large APs are achieved at low flows as well. Because the plunger-driven diaphragm pump is provided with a spring for returning the diaphragm during pump operation, the pump is capable of pumping the absorption fluid at subatmospheric solution pressures, thereby providing pumping of the absorption solution at low ambient temperatures below 40° F. and as low as −20° F. and below. Moreover, the pump described herein is capable with providing ΔP over 500 psia, and up to 550 psia or more. Operating frequencies of the pump, that is the reciprocating cycle of frequencies of the plunger, are between about 20 and about 250 strokes per minute, and preferably between about 60-200 strokes, and more preferably between about 70 and about 160 strokes per minute. The pump may be operated even at dry or near dry conditions to pump gas and gas-liquid mixtures.

V. Overview of Example Fluid Ends

Figure 5A:
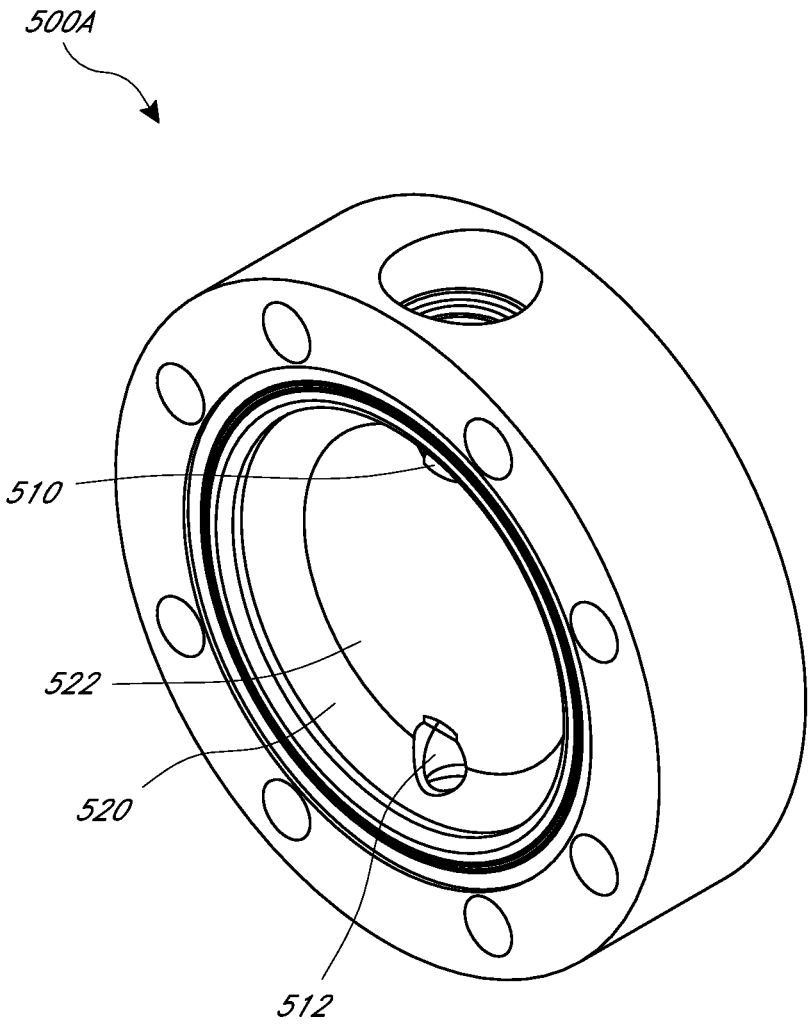
FIG. 5A (Prior Art)
FIGS. 5A-5C illustrate various embodiments of a fluid end of a solution chamber.
Figure 5B:
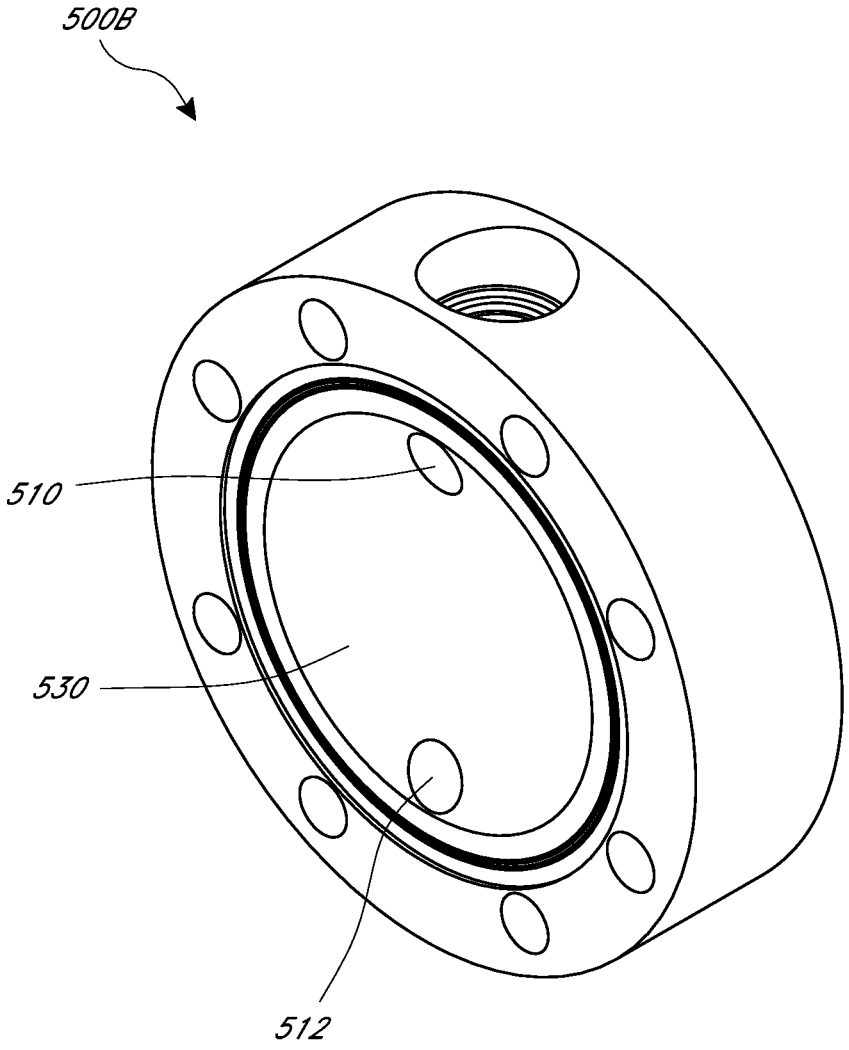
Figure 5C:
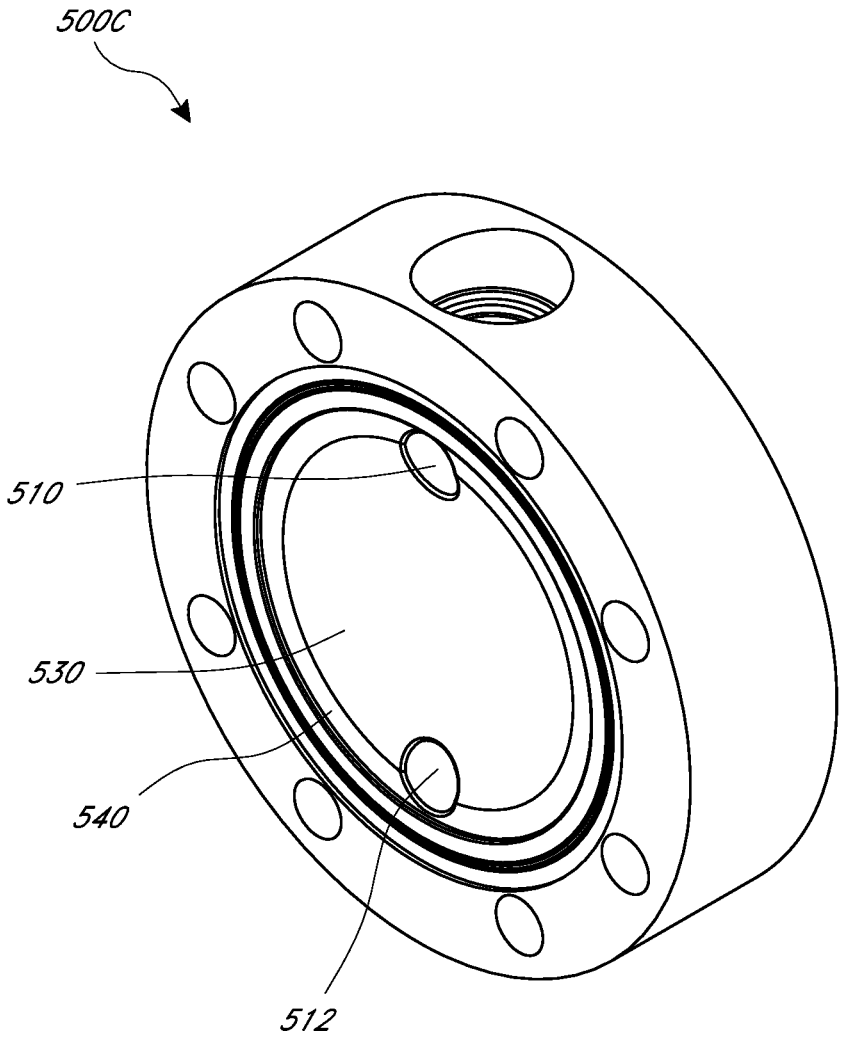

FIGS. 5A-5C illustrate various embodiments of a fluid end suitable for use in the solution chamber of a solution pump. FIG. 5A illustrates a prior art fluid end 500A having a concave perimeter 520 leading to a deeply recessed solution chamber wall 522. The fluid end includes inlet and outlet ports 512, 510 for moving solution into and out of the solution chamber.

FIG. 5B illustrates an embodiment of a fluid end 500B having a concave solution chamber wall 530 shaped such that a diaphragm, in a fully deflected state, substantially conforms to the concave solution chamber wall 530. When a diaphragm is deflected against the concave solution chamber wall 530, it can be pressed at least partially into the inlet and outlet ports 512, 510. Over time, the deformation of the diaphragm into the inlet and outlet ports can cause permanent dimples in the diaphragm corresponding to the stretching of the diaphragm into the ports. Significant dimpling of the diaphragm, referred to herein as embossing, causes inadequate performance of the pump. For example, embossing can lead to the diaphragm becoming stuck in one or both ports, failure of the diaphragm, or reduced performance with respect to flow and/or priming. Embossing can also reduce the useful life of the diaphragm.

FIG. 5C illustrates a fluid end 500C having a similar concave solution chamber wall 530 that includes a step 540 circumscribing the outer edge of the chamber wall 530 and also traversing the inlet and outlet ports 512, 510. The step 540 creates a sufficient gap such that when contacted by the diaphragm, it does not become deformed or embossed due to being pressed into the inlet and outlet ports 512, 510. The step 540 also does not significantly increase the volume of the solution chamber formed by the solution chamber wall 530, thereby maintaining the high suction capabilities of the pump. In some embodiments, as illustrated, the step 540 may traverse the inlet and outlet ports 512, 510. In other embodiments, the ports may not be positioned symmetrically and the step may traverse one of the inlet and outlet ports and not the other of the inlet and outlet ports. In another embodiment, the step can be positioned near to the inlet and outlet ports without traversing the ports.

VI. Terminology

Features, materials, characteristics, or groups described in conjunction with a particular aspect, embodiment, or example are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

While certain embodiments have been described, these embodiments have been presented by way of example only, and are not intended to limit the scope of protection. Indeed, the novel methods and systems described herein may be embodied in a variety of other forms. Furthermore, various omissions, substitutions and changes in the form of the methods and systems described herein may be made. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure.

Although the present disclosure includes certain embodiments, examples and applications, it will be understood by those skilled in the art that the present disclosure extends beyond the specifically disclosed embodiments to other alternative embodiments and/or uses and obvious modifications and equivalents thereof, including embodiments which do not provide all of the features and advantages set forth herein. Accordingly, the scope of the present disclosure is not intended to be limited by the specific disclosures of preferred embodiments herein, and may be defined by claims as presented herein or as presented in the future.

What is claimed is:

1. A diaphragm pump comprising:

a solution chamber configured to contain a varying volume of an absorption fluid, the solution chamber comprising a concave solution chamber wall having a fluid inlet port and a fluid outlet port and having a single step circumscribing an outer edge of the solution chamber wall;

a hydraulic fluid chamber configured to contain a varying volume of a hydraulic fluid, the hydraulic fluid chamber comprising a contoured fluid chamber wall; and a flexible diaphragm coupled around a perimeter at an interface between the solution chamber and hydraulic fluid chamber, wherein the varying volume of hydraulic fluid deflects the flexible diaphragm between an outwardly deflected position thereby forcing at least some of the absorption fluid through the fluid outlet port and an inwardly deflected position thereby drawing at least some of the absorption fluid through the fluid inlet port, wherein the flexible diaphragm, in the outwardly deflected position, conforms to the contoured solution chamber wall, and wherein the step prevents deformation of the diaphragm by the fluid inlet or fluid outlet ports.

2. The diaphragm pump of claim 1, wherein the diaphragm pump is a plunger-driven direct drive pump.

3. The diaphragm pump of claim 1, wherein the diaphragm pump is connected to an absorber and is capable of suctioning liquid and vapor out from the absorber.

4. The diaphragm pump of claim 1, wherein the step is sized such that the step does not increase the volume of the solution chamber with respect to a shape of the flexible diaphragm in the outwardly deflected position.

5. The diaphragm pump of claim 1, wherein the concave solution chamber wall conforms to a predetermined radius.

6. The diaphragm pump of claim 5, wherein the flexible diaphragm has a predetermined radius that is the same as the predetermined radius of the interior wall of the solution chamber.

7. The diaphragm pump of claim 1, wherein the fluid inlet port and the fluid outlet port comprise one-way valves.

8. The diaphragm pump of claim 7, wherein the fluid inlet port is in fluid communication with an inlet pipe configured to draw fluid into the solution chamber.

9. The diaphragm pump of claim 8, wherein the inlet pipe is in fluid communication with an absorber.

10. The diaphragm pump of claim 8, wherein the diaphragm pump is capable of self-priming a solution through six inches of liquid column height.

11. The diaphragm pump of claim 8, wherein the diaphragm pump is capable of self-priming a solution through twelve inches of liquid column height.

12. The diaphragm pump of claim 8, wherein the diaphragm pump is capable of self-priming a solution through 24 inches of liquid column height.

13. The diaphragm pump of claim 1, comprising an output shaft configured to laterally move an eccentric D-ring that reciprocally drives a plunger with respect to the diaphragm.

14. The diaphragm pump of claim 13, wherein the eccentric D-ring comprises at least one flat portion that contacts the plunger to reciprocally drive the plunger with respect to the diaphragm.

15. The diaphragm pump of claim 14, wherein the eccentric D-ring maintains an orientation with respect to a plane formed by the at least one flat portion.

16. A method for self-priming a diaphragm pump, the method comprising:

providing the diaphragm pump of claim 1 in fluid communication with a solution including the absorption fluid; and operating the pump when there is less than full volume or no solution in the solution chamber so that the pump draws the solution into the solution chamber.

17. The method of claim 16, wherein the diaphragm pump is connected to the solution through a fluid inlet pipe, and the solution in the fluid inlet pipe is an aqueous ammonia solution.

18. The method of claim 16, wherein the diaphragm pump is capable of self-priming a solution through six inches of liquid column height.

19. The method of claim 16, wherein the diaphragm pump is capable of self-priming a solution through twelve inches of liquid column height.

20. The method of claim 16, wherein the diaphragm pump is capable of self-priming a solution through twenty four inches of liquid column height.

21. The method of claim 16, wherein the concave solution chamber wall conforms to a predetermined radius.

22. The method of claim 16, wherein the flexible diaphragm has a predetermined radius that is the same as the predetermined radius of the concave solution chamber wall.

23. A diaphragm pump comprising:

a solution chamber comprising a concave solution chamber wall having a fluid inlet port and a fluid outlet port and having a single step circumscribing an outer edge of the solution chamber wall;

a hydraulic fluid chamber configured to contain a varying volume of a hydraulic fluid, the hydraulic fluid chamber comprising a contoured fluid chamber wall; and a flexible diaphragm coupled around a perimeter at an interface between the solution chamber and hydraulic fluid chamber, the perimeter located around a common edge of the solution chamber and hydraulic fluid chamber with the outer edge circumscribed by the step adjacent to the perimeter around the common edge, wherein the varying volume of hydraulic fluid deflects the flexible diaphragm between an outwardly deflected position and an inwardly deflected position, wherein the flexible diaphragm, in the outwardly deflected position, conforms to the contoured solution chamber wall, and wherein the step prevents deformation of the diaphragm by the fluid inlet or fluid outlet ports.

* * * * *